US007578149B2

(12) United States Patent
Schmid et al.

(10) Patent No.: US 7,578,149 B2
(45) Date of Patent: Aug. 25, 2009

(54) MOTOR AS A DIRECT DRIVE AND METHOD FOR INSTALLATION OF THE MOTOR

(75) Inventors: Bertram Schmid, Amtzell (DE); Rainer Holzer, Freilassing (DE); Thomas Mehrer, Rohrhof (DE)

(73) Assignee: Diehl AKO Stiftung & Co. KG, Wangen (DE)

( * ) Notice: Subject to any disclaimer, the term of this patent is extended or adjusted under 35 U.S.C. 154(b) by 640 days.

(21) Appl. No.: 11/059,934

(22) Filed: Feb. 17, 2005

(65) Prior Publication Data

US 2005/0210604 A1 Sep. 29, 2005

(30) Foreign Application Priority Data

Mar. 24, 2004 (DE) ..... 10 2004 014 259
Oct. 12, 2004 (DE) ..... 10 2004 049 549

(51) Int. Cl.
*B08B 3/12* (2006.01)

(52) U.S. Cl. ..... 68/3 R; 8/159; 68/131; 68/139; 68/140; 310/10; 310/40 R; 310/254; 310/261

(58) Field of Classification Search ..... None
See application file for complete search history.

(56) References Cited

U.S. PATENT DOCUMENTS 4,998,339 A * 3/1991 Wiesner ..... 29/606
5,040,285 A 8/1991 Williams et al.
5,150,589 A 9/1992 Williams et al.
6,341,507 B1 * 1/2002 Rode et al. ..... 68/12.16
6,481,035 B2 * 11/2002 Seagar et al. ..... 8/159
6,499,323 B2 * 12/2002 Skrippek et al. ..... 68/140

FOREIGN PATENT DOCUMENTS

| | | | |
|---|---|---|---|
| DE | 199 37 229 | A1 | 2/2001 |
| DE | 100 56 986 | A1 | 5/2002 |
| DE | 100 58 409 | A1 | 5/2002 |
| DE | 100 60 940 | A1 | 6/2002 |
| EP | 0 361 775 | B1 | 4/1990 |
| EP | 1 094 144 | A2 | 4/2001 |

* cited by examiner

*Primary Examiner*—Michael Kornakov
*Assistant Examiner*—Eric Golightly
(74) *Attorney, Agent, or Firm*—Laurence A. Greenberg; Werner H. Stemer; Ralph E. Locher

(57) ABSTRACT

A motor having a stator and a rotor is provided as a direct drive for a laundry treatment appliance. The stator of the motor is preferably centered by a preferably cylindrical or conical protuberance in a bearing hole in a bearing spider or a rear wall of a tub of the laundry treatment appliance. The stator may have lugs on pole insulation which guide the rotor during installation, so that permanent-magnet poles of the rotor cannot strike soft-magnetic poles of the stator. A method for installation of the motor is also provided.

17 Claims, 5 Drawing Sheets

MOTOR AS A DIRECT DRIVE AND METHOD FOR INSTALLATION OF THE MOTOR

BACKGROUND OF THE INVENTION

Field of the Invention

The present invention relates to a motor. The invention also relates to a method for installation of the motor as a direct drive element for a laundry treatment appliance.

Laundry treatment appliances include, among others, washing machines, spin driers and tumble driers. Those machines include a drum which is mounted in a tub so as to be rotatable and is driven by a motor. The drum is constructed to accommodate laundry and can be loaded from the front or from the top in a known manner. Nowadays, direct drives (that is to say direct-drive motors, meaning motors which drive the drum shaft without the transmission of power through the use of belts or gears) are increasingly being used as drive motors due to their good controllability and their virtually unlimited service life. Direct drives may be in the form of external rotors or in the form of internal rotors. Direct drives have no parts which are subject to wear, such as belts or gears. In external rotor motors, the stator includes poles (laminated cores) which are disposed in a circle, are insulated and have pole windings. Permanent-magnet poles which are seated on the inner periphery of an external rotor, which is usually in the form of a bell, are situated opposite the stator. An actual air gap is, for example, 0.5-2 mm. Due to the air gap, which is small in relation to the circumference of the motor, both precise positioning of the stator with respect to the drum bearing and secure fixing are necessary. The insulation of the pole windings must satisfy creepage distance requirements for domestic appliances. The magnets of the rotor (external rotor or internal rotor) must not strike the poles of the stator during installation. The following exemplary approaches to meeting those requirements are known from the prior art:

According to European Patent 0 361 775 B1, corresponding to U.S. Pat. No. 5,040,285 and U.S. Pat. No. 5,150,589, the windings of the stator, the rear wall of the tub and the bearing spider with a bearing hole for the drum shaft, form one unit. They are in the form of a plastic injection-molded part with inserts. That has the disadvantages of poor heat dissipation and a large amount of creepage-current-resistant plastic material being required.

According to German Published, Non-Prosecuted Patent Application DE 199 37 229 A1, the drum shaft opposite the stator is additionally mounted by using a ball bearing in order to be seated in the center. The additional bearing requires a higher additional outlay.

According to German Published, Non-Prosecuted Patent Application DE 100 56 986 A1, an installation part is secured, for example, to the drive shaft of the drum in order to install the drive elements centrally. That installation part must be detached and removed again following installation. That involves great effort.

According to German Published, Non-Prosecuted Patent Application DE 100 60 940 A1, projections for engaging in the stator during installation such that it is guided are provided on a supporting star in order to install the stator centrally. The disadvantage thereof is that the bearing spider and the rear wall of the tub are complicated.

SUMMARY OF THE INVENTION

It is accordingly an object of the invention to provide a motor as a direct drive that is simple to install and a method for installation of the motor on a laundry treatment appliance, which overcome the hereinafore-mentioned disadvantages of the heretofore-known devices and methods of this general type.

With the foregoing and other objects in view there is provided, in accordance with the invention, in a laundry treatment appliance having a tub with a rear wall, a bearing spider having a bearing hole, and a drum having a drum shaft with bearings accommodated in the bearing hole for mounting the drum rotatably in the bearing spider or in the rear wall of the tub, a motor in the form of an external rotor motor or an internal rotor motor as a direct drive for the laundry treatment appliance. The motor comprises a stator having a hole through which the drum shaft passes. The hole in the stator defines an edge having a preferably cylindrical or conical protuberance engaging in the bearing hole or in the rear wall of the tub and effecting centering of the stator hole relative to the bearing hole. The stator has field coils fixed to the bearing spider or to the rear wall of the tub. A rotor is secured on one end of the drum shaft and separated from the stator by a narrow air gap, for transmitting a torque to the drum.

A bearing hole in a bearing spider and/or in a rear wall of the tub is precisely machined in order to seat ball bearings. The invention uses this defined, smooth hole, which is needed in any case, in order to center the stator. In order for this to be possible, the stator has the preferably cylindrical or conical protuberance in the middle of that surface which faces the tub. The protuberance fits exactly into the hole in the bearing spider and/or in the rear wall of the tub.

In accordance with another feature of the invention, the stator may be composed, for example, of two electrically insulating plastic shells to which the laminated core is fitted.

In accordance with a further feature of the invention, the two plastic shells, one inner shell and one outer shell, are precision injection-molded parts. The inner shell has, in the middle, the protuberance which fits exactly into the bearing hole. In addition to their holding function, the two plastic shells form the insulation for the pole windings of the stator poles. In order to be able to comply with the required, long creepage-current path between the laminated core of the stator and the stator winding, the two plastic shells overlap.

In accordance with an added feature of the invention, the laminated core is placed into the shells during production of the stator. The two shells are held together by latching lugs (for example on the inner shell). Once the poles are wound, the entire stator may be placed with the inner protuberance in the center of the supporting star and fixed in a conventional manner, for example by using screws. These screws are screwed through the two spacers in the outer plastic shell into the bearing spider and/or the rear wall of the tub. They are thus isolated from the laminated core of the stator.

In accordance with an additional feature of the invention, the outer plastic shell has, for example, molded lugs above the pole insulation in the direction of the rotor bell. The outside diameter across the lugs corresponds to the inside diameter of a rotor bell with its permanent-magnet poles. According to the invention, these lugs are used for the problem-free installation of the rotor bell. The rotor bell is pushed over the lugs in the direction of the drum. In the process, the inner hole in the bell is pushed onto the drum shaft and the rotor bell is thus held centrally. The rotor bell cannot strike the soft-magnetic poles of the stator, even when driven by the magnetic forces of the permanent-magnet poles. Damage to the permanent magnets of the rotor bell is thus prevented. When the rotor bell is fully pushed on, the lugs are situated inside the rotor bell and adjacent the permanent-magnet poles of the rotor bell with a lateral offset outwards. The rotor bell can rotate freely. The rotor bell can be fixed on the drum shaft in any conventional manner, for example by using a nut. In an analogous manner, the same principle applies to an internal rotor as to the external rotor described above.

In accordance with yet another feature of the invention, the lugs on the outer plastic shell do not have to be molded. The same installation is possible using a lug part, for example made from plastic, which is snapped onto the outer shell. In this case, the pole windings for the stator poles could be wound independently of this lug part and be pushed over the poles before the lug part is secured.

The principle of the invention, to center the stator in the bearing hole in the bearing spider and/or the rear wall of the tub, can also be implemented using an auxiliary part in order to install the stator. In this case, the auxiliary part has, in the middle, the preferably cylindrical or conical protuberance which fits exactly into the bearing hole. The auxiliary part could, for example, be in the form of a bell into which the maximum outside diameter of the stator just fits. The entire stator would be pushed onto the bearing spider and/or the rear wall of the tub together with the auxiliary part and then screwed tight through holes in the auxiliary part using screws, for example. The auxiliary part would thereafter be removed again and the rotor installed as described above.

With the objects of the invention in view, there is accordingly also provided a method for installation of a motor having a stator and a rotor, for direct drive of a laundry treatment appliance having a tub with a rear wall and a bearing spider with a bearing hole. The method comprises providing an auxiliary part having a preferably cylindrical or conical protuberance. The stator is installed by engaging the protuberance in the bearing hole or in the rear wall of the tub, for centering the stator with the auxiliary part.

Thus, implementation of some of the features described above results in a method for the installation of a motor as a direct drive for a laundry treatment appliance in which the stator can be installed exactly in the center in a simple manner and without additional manipulation of a largely conventional bearing system, and the rotor bell can be installed without the risk of damaging its permanent magnets.

Other features which are considered as characteristic for the invention are set forth in the appended claims.

The invention is illustrated and described herein as embodied in a motor as a direct drive and a method for installation of the motor.

However, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
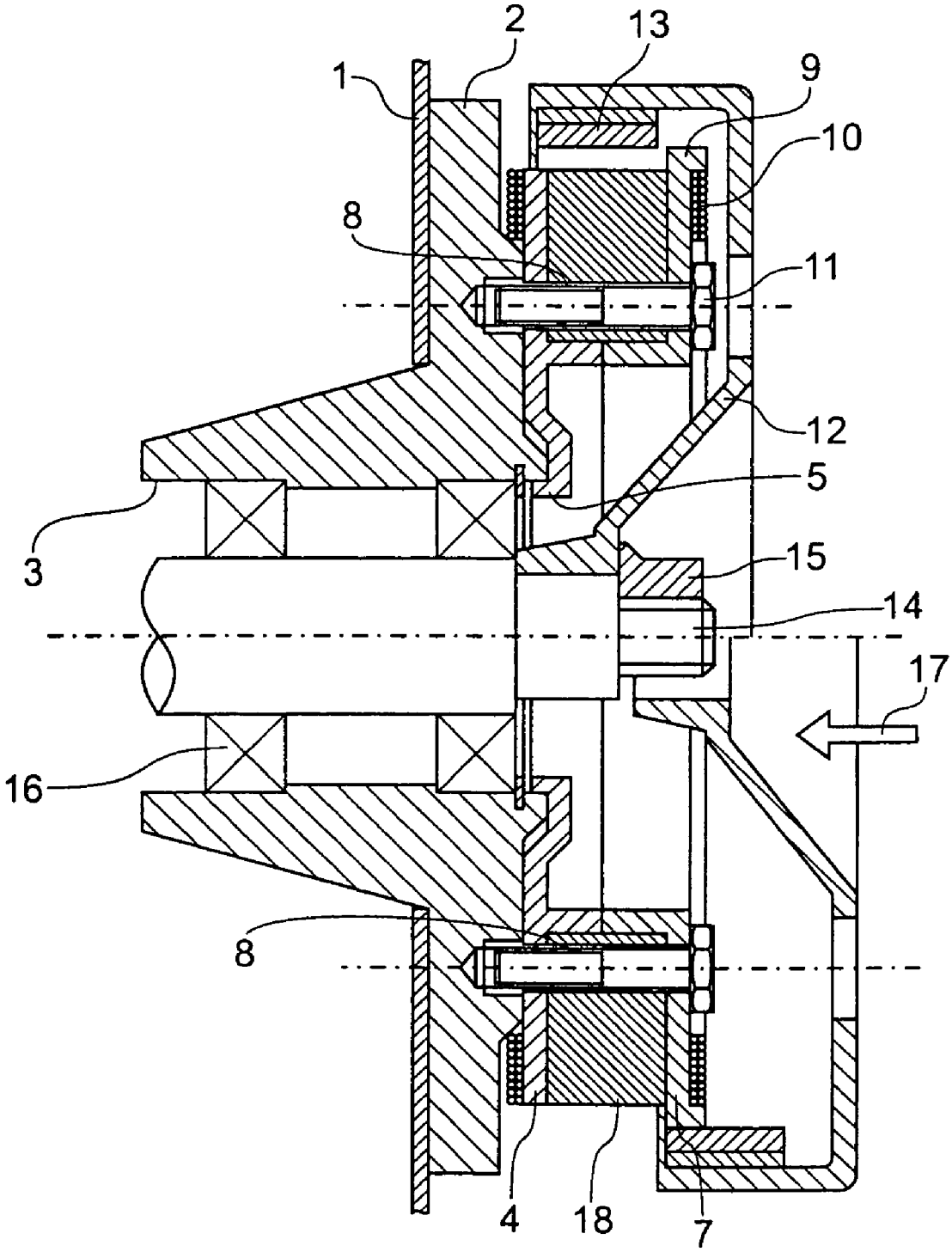
FIG. 1 is a fragmentary, diagrammatic, sectional view of a motor as a direct drive for a laundry treatment appliance.

Referring now to the figures of the drawings in detail and first, particularly, to FIG. 1 thereof, there is seen a sectional illustration of a direct drive which is completely installed on a laundry treatment appliance. Only part of a tub of the laundry treatment appliance, its rear wall 1, is illustrated. A bearing spider 2 is attached in a fixed position to the rear wall 1 of the tub. The bearing spider 2 has a hole 3 in the middle, which is precisely machined to seat a drum bearing 16. A cylindrical protuberance 5 formed on an inner plastic shell 4 is disposed at a stator 18 having laminated cores. The protuberance 5 projects with a precise fit into the hole 3 in the bearing spider 2 and thus guarantees a central seating of the stator 18. The stator 18 is held firmly on the bearing spider 2 in a known manner by screws 11. The screws 11 are isolated from laminated cores of the stator 18 by hollow spacers 8.

Figure 2:
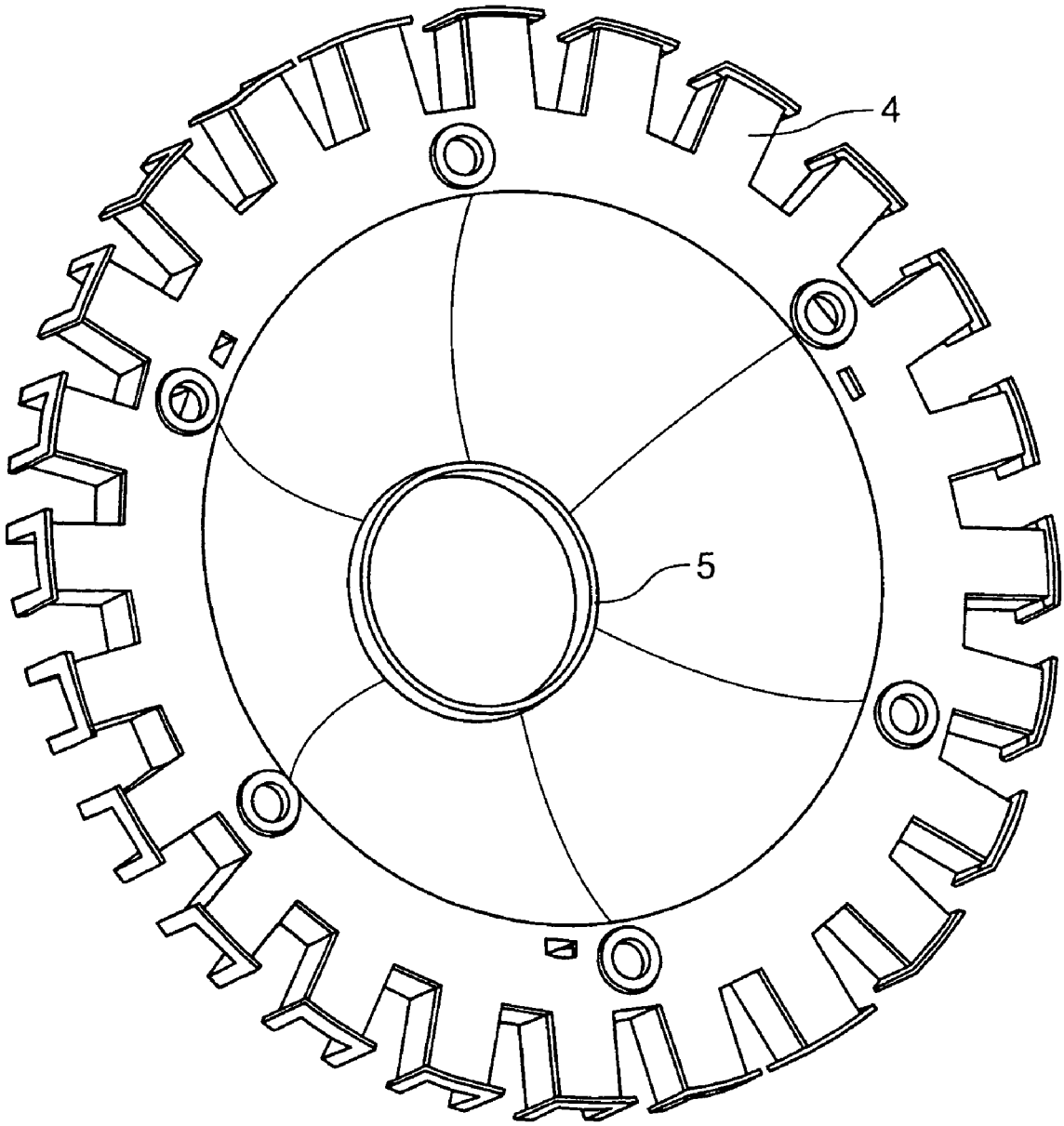
FIG. 2 is a perspective view of an inner plastic shell of a stator as seen from a rear wall of a tub.
Figure 3:
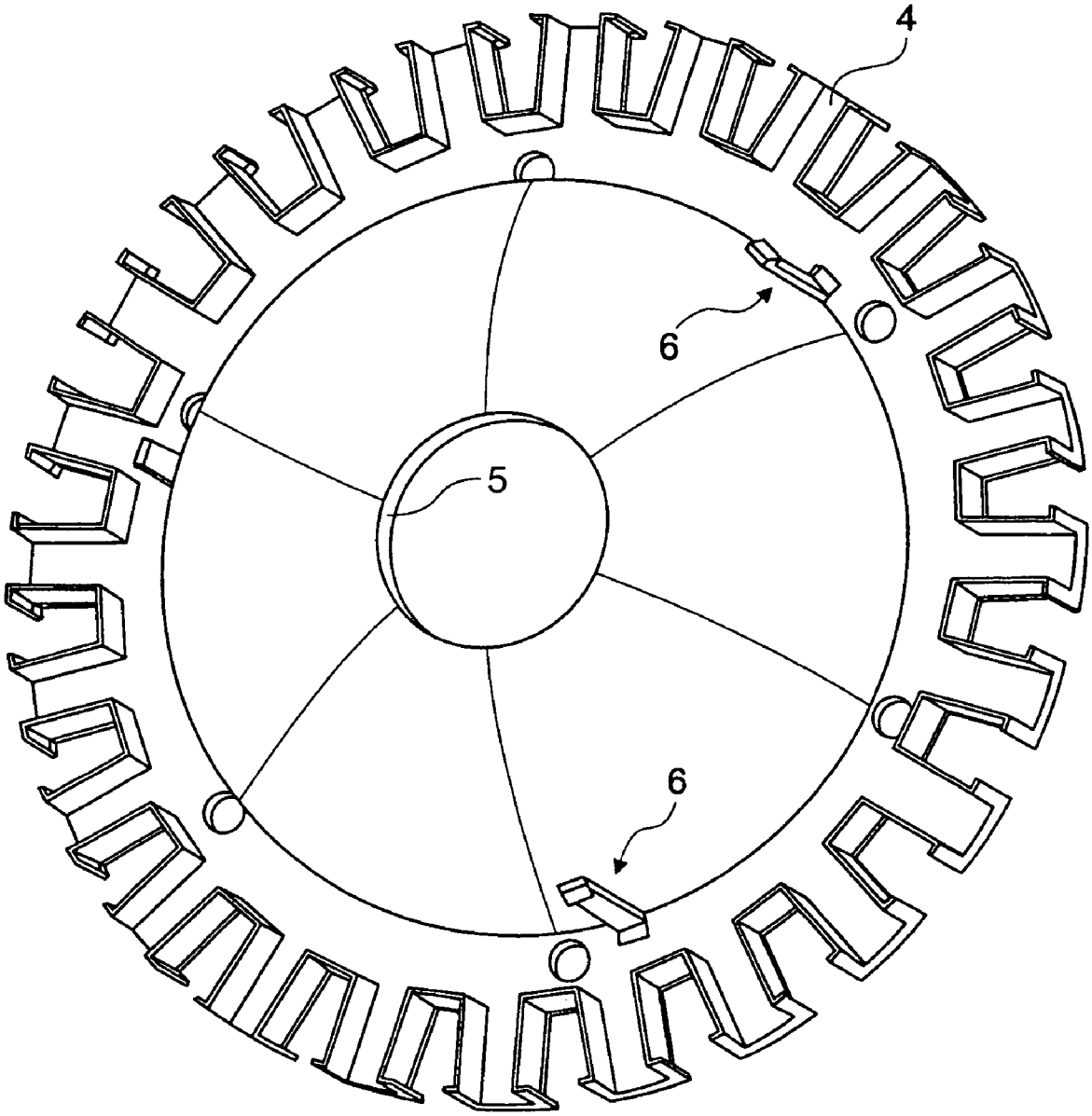
FIG. 3 is a perspective view of the inner plastic shell of the stator as seen from a rear wall of the laundry treatment appliance.
Figure 4:
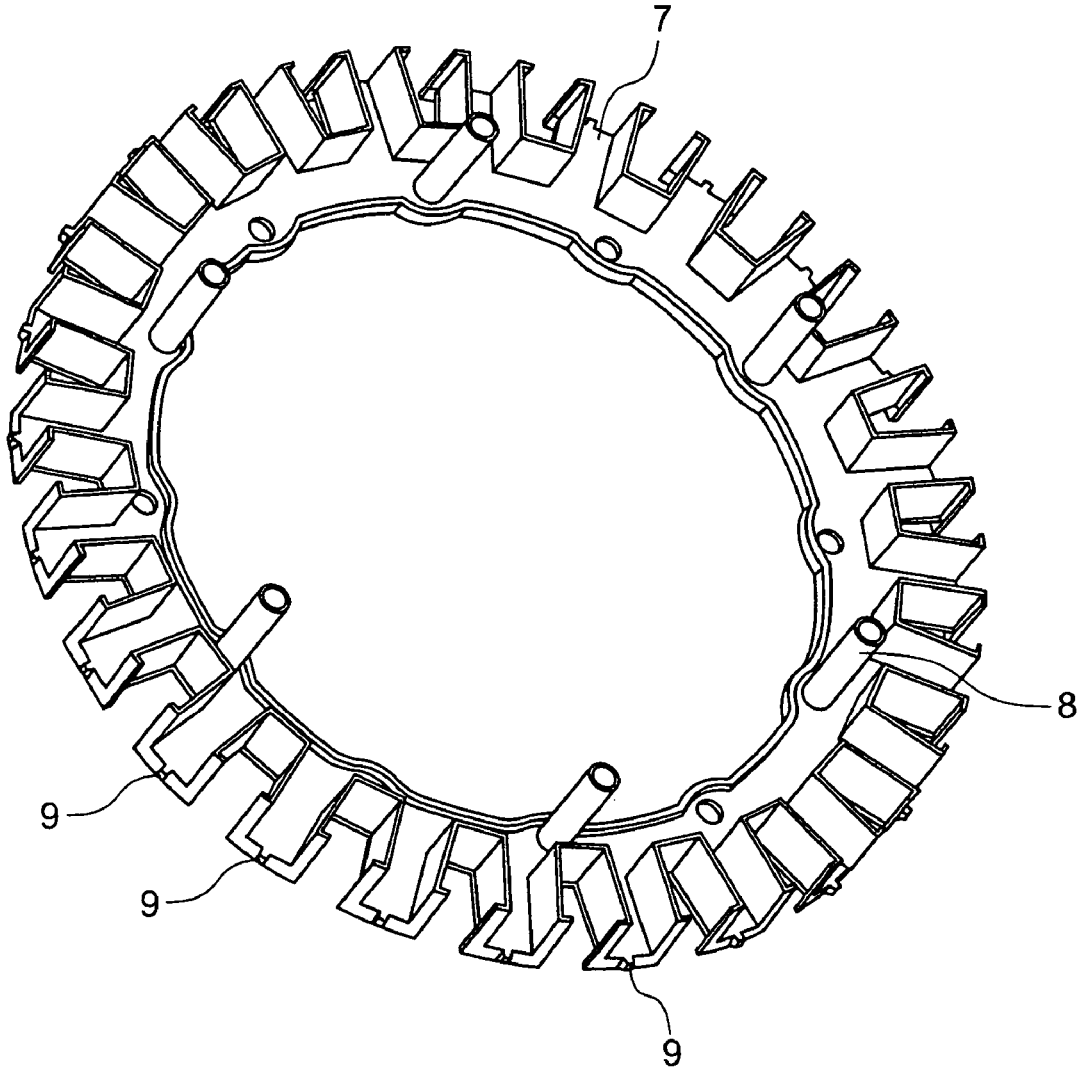
FIG. 4 is a perspective view of an outer plastic shell of the stator as seen from the rear wall of the tub.

The stator 18 is formed by the inner plastic shell 4, which is also seen in FIGS. 2 and 3, an outer plastic shell 7, which is also seen in FIG. 4, and inserted laminated cores. The plastic shells 4 and 7 are held together by snap-action hooks 6 shown in FIG. 3. The snap-action hooks 6 are attached to the inner plastic shell 4. In the installed state, the plastic shells 4 and 7 are held firmly in their positions by the screws 11. Pole windings or field coils 10 of stator poles are insulated from the laminated cores by the plastic shells 4 and 7.

A rotor bell 12 is provided with permanent-magnet poles 13 on the inside, in a known manner. During installation, the rotor bell 12 is pushed onto a drum shaft 14 in a direction of movement 17, that is to say from the outside, from a location shown at the lower half of FIG. 1 to a location shown at the upper half of FIG. 1. In the process, the rotor bell 12 firstly comes into contact with lugs 9 on the outer plastic shell 7. During installation, the poles 13 of the rotor bell 12 slide over the lugs 9 on the outer plastic shell 7. At the same time, an inner hole in the rotor bell is pushed over the drum shaft 14. In the completely installed state, the lugs 9 are spaced apart from and are adjacent the poles 13 of the rotor bell 12. The rotor bell 12 can rotate freely, and is connected firmly to the drum shaft 14 by a nut 15.

Figure 5:
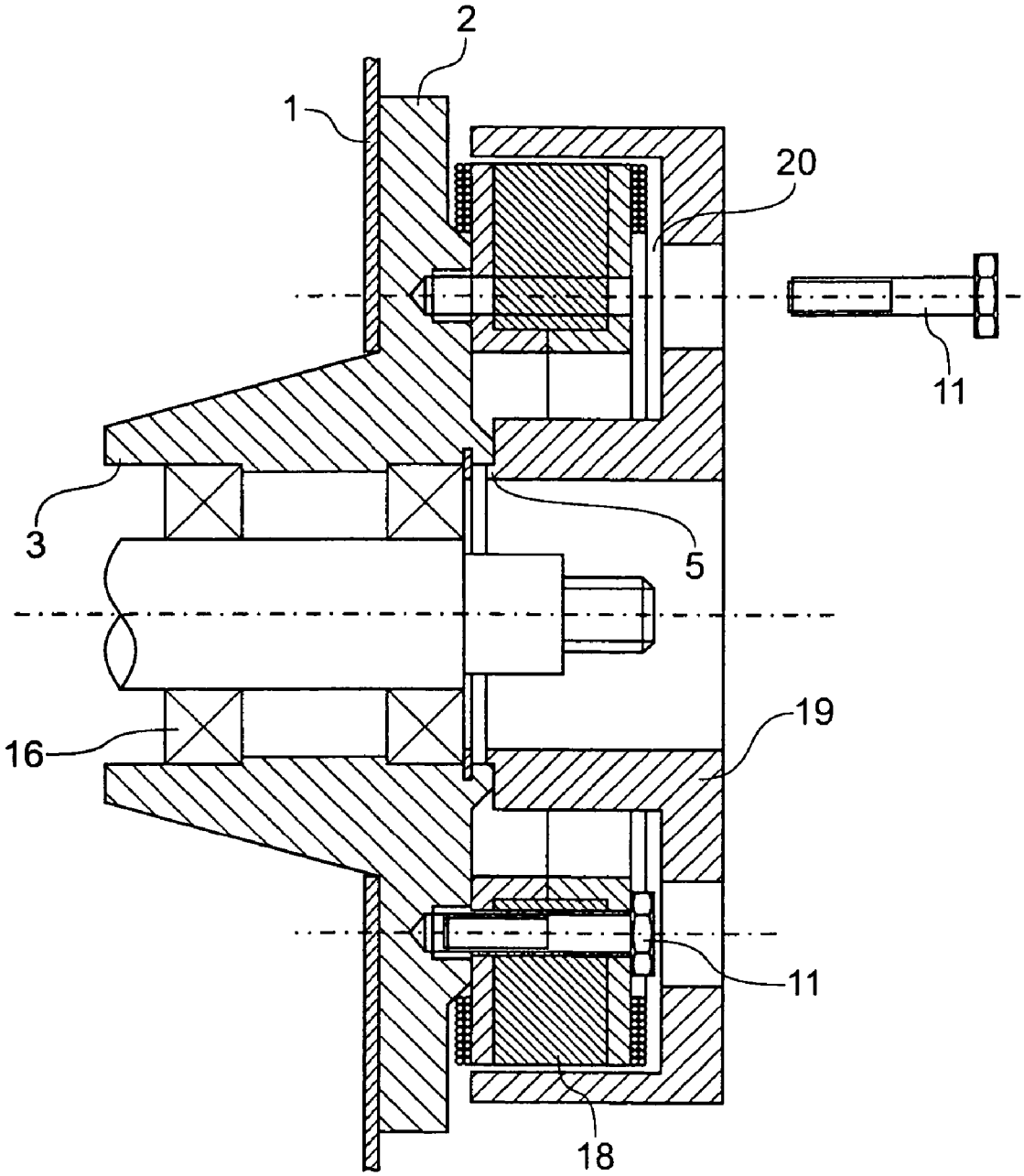
FIG. 5 is a sectional view similar to FIG. 1 of the motor with an auxiliary part for installation of the stator on a supporting star.

The direct drive described herein can also be formed by a motor which contains a stator 18 that has been installed as shown in FIG. 5. An auxiliary part 19 for installation of the stator 18 has a cylindrical protuberance 5 in the middle. The stator 18 is held in a bell 20 of the auxiliary part 19. The auxiliary part 19 is placed with the stator 18 onto the bearing spider 2 and/or the rear wall 1 of the tub. The auxiliary part 19 is centered through the use of the cylindrical protuberance 5. The stator 18 is fixed by using screws 11, for example, and the auxiliary part 19 is then removed.

This application claims the priority, under 35 U.S.C. § 119, of German Patent Application Nos. 10 2004 014 259.9 filed Mar. 24, 2004, and 10 2004 049 549.1 filed Oct. 12, 2004; the entire disclosure of the prior applications is herewith incorporated by reference.

We claim:

1. A motor for the direct drive of a laundry treatment appliance having a tub with a rear wall, a bearing hole located through the rear wall of the tub or through a bearing spider attached to the rear wall of the tub, and a drum having a drum shaft with bearings accommodated in the bearing hole for mounting the drum rotatably in the bearing spider or in the rear wall of the tub, an inner face of the bearing hole being coaxial with the drum shaft, the motor comprising:

a stator having a hole through which the drum shaft passes, said hole in said stator defining an edge having a protuberance, said protuberance extending into the bearing hole and directly contacting the coaxial inner face of the bearing hole to effect centering of the stator hole relative to the bearing hole, said stator having field coils fixed to the bearing spider or to the rear wall of the tub; and a rotor secured on one end of the drum shaft and separated from said stator by a narrow air gap, for transmitting a torque to the drum.

2. The motor according to claim 1, wherein the motor is an external rotor motor.

3. The motor according to claim 1, wherein the motor is an internal rotor motor.

4. The motor according to claim 1, wherein said protuberance is cylindrical.

5. The motor according to claim 1, wherein said protuberance is conical.

6. The motor according to claim 1, wherein said stator is formed from an inner shell and an outer shell holding laminated stator poles.

7. The motor according to claim 6, wherein said inner shell and said outer shell overlap providing insulation for pole windings.

8. The motor according to claim 6, wherein:

said rotor is a rotor bell having an inside diameter;

lugs are attached to said outer shell, facing said rotor bell;

a diameter of said outer shell across said lugs is smaller than said inside diameter of said rotor bell; and said lugs provide centering guidance during installation of said rotor bell.

9. The motor according to claim 8, wherein said lugs are separate guide lugs secured on said stator.

10. The motor according to claim 9, wherein said stator pole windings are pushed over said laminated poles as prefabricated shaped parts, permitting said guide lugs to be secured to said stator.

11. The motor according to claim 10, wherein said windings are a baked winding.

12. The motor according to claim 9, which further comprises pole insulations for said stator each being a dedicated component having one of said guide lugs attached thereto and wound separately, said components being pushed over said stator poles following winding and latched to said inner shell and said outer shell.

13. The motor according to claim 1, wherein said stator is an injection-molded part having a laminated core encapsulated by injection molding with plastic as an insert in an injection-molding die.

14. The motor according to claim 1, wherein said stator has stator poles with windings wound directly through spaces between said poles onto said stator.

15. A motor for providing a direct drive for a laundry treatment apparatus including a tub with a rear wall, a bearing hole located through the rear wall of the tub or through a bearing spider attached to the rear wall of the tub, and a drum having a drum shaft with bearings accommodated in the bearing hole for mounting the drum rotatably in the bearing spider or in the rear wall of the tub, an inner face of the bearing hole being coaxial with the drum shaft, the motor comprising:

a stator assembly including field coils fixed to the bearing spider or to the rear wall of the tub and a stator hole through which a portion of the drum shaft passes;

said stator assembly including a protuberance located at an edge of said stator hole on a surface of the stator assembly facing the tub, said protuberance extending into the bearing hole and directly contacting the coaxial inner face of the bearing hole to effect centering of the stator hole relative to the bearing hole; and a rotor secured on one end of the drum shaft and separated from said stator by a narrow air gap, for transmitting a torque to the drum.

16. The motor of claim 15, wherein the protuberance is a cylindrical or conical protuberance circumscribing the stator hole.

17. The motor of claim 15, wherein the stator assembly includes an auxiliary part in communication with a stator.

* * * * *